US005937829A

United States Patent [19]

Endou

[11] Patent Number: 5,937,829

[45] Date of Patent: Aug. 17, 1999

[54] FUEL PUMP DRIVE APPARATUS FOR FUEL INJECTION EQUIPMENT FOR INTERNAL COMBUSTION ENGINE

[75] Inventor: Tsuneaki Endou, Numazu, Japan

[73] Assignee: Kokusan Denki Co., Ltd., Shizuoka-ken, Japan

[21] Appl. No.: 08/931,581

[22] Filed: Sep. 16, 1997

[51] Int. Cl.[6] ..... F02M 37/04

[52] U.S. Cl. ..... 123/497; 123/478; 123/179.17

[58] Field of Search ..... 123/497, 179.17, 123/456, 490, 478

[56] References Cited

U.S. PATENT DOCUMENTS

| | | | |
|---|---|---|---|
| 4,791,905 | 12/1988 | Furata | 123/497 |
| 4,932,387 | 6/1990 | Flam | 123/497 |
| 4,960,097 | 10/1990 | Tachibana et al. . | |
| 4,982,331 | 1/1991 | Miyazaki | 123/497 |
| 5,050,559 | 9/1991 | Kurosu et al. . | |
| 5,092,302 | 3/1992 | Mohan | 123/497 |
| 5,293,299 | 3/1994 | Iwabochi | 123/497 |
| 5,373,827 | 12/1994 | Kondou et al. . | |
| 5,502,963 | 4/1996 | Inaba | 123/497 |
| 5,555,822 | 9/1996 | Takeuchi | 123/497 |
| 5,672,051 | 9/1997 | Forque | 123/497 |

FOREIGN PATENT DOCUMENTS 60-147563 8/1985 Japan .

*Primary Examiner*—Carl S. Miller

*Attorney, Agent, or Firm*—Pearne, Gordon, McCoy & Granger LLP

[57] ABSTRACT

A fuel pump drive apparatus for a fuel injection equipment for an internal combustion engine capable of satisfactorily driving a fuel pump for a fuel injection equipment without being affected by a variation in a voltage across a battery. A magneto driven by the internal combustion engine is provided with a battery charging coil and a pump drive coil. An output of the pump drive coil is fed to a pump drive motor through a pump drive circuit including a voltage regulator. A diode is connected between a positive output terminal of a battery charging circuit and a positive output terminal of a pump drive circuit, so that a current is fed from the battery through the diode to the pump drive motor only when a voltage across the battery is higher than an output voltage of the pump drive circuit. The voltage regulator of the pump drive circuit has an adjustment value set to be higher than a maximum value of the voltage across the battery.

18 Claims, 7 Drawing Sheets

FUEL PUMP DRIVE APPARATUS FOR FUEL INJECTION EQUIPMENT FOR INTERNAL COMBUSTION ENGINE

BACKGROUND OF THE INVENTION

This invention relates to a fuel pump drive apparatus for a fuel injection equipment for an internal combustion engine, and more particularly to a fuel pump drive apparatus for driving a fuel pump of a fuel injection equipment for an internal combustion engine.

A fuel injection equipment for an internal combustion engine generally includes a fuel pump, a fuel injector or fuel injection valve fed with fuel by the fuel pump, a pressure regulator for controlling a pressure of fuel fed from the fuel pump to the fuel injector, an injector drive circuit for feeding a drive current to the injector in response to an injection command pulse, a fuel injection control unit for feeding the injector drive circuit with an injection command pulse so as to render the amount of fuel injected from the injector equal to a fuel injection quantity demanded by the internal combustion engine at each of rotational speeds of the engine.

The fuel pump is constituted by a drive source such as a pump drive motor or the like which is fed with a drive current from a DC power supply, as well as a pump mechanism driven by the drive source. The fuel pump functions to pump oil out of a fuel tank to feed it to the injector.

The fuel injector includes a valve body provided at a distal end thereof with an injection port, a valve arranged in the valve body to selectively close the injection port and a solenoid coil for actuating the valve and functions to feed fuel from the fuel pump into the valve body. The injector is arranged so as to inject fuel into a fuel injection space such as an interior of an air intake pipe of the internal combustion engine, an interior of a cylinder thereof or the like.

The injector drive circuit is constituted by a switch circuit including a transistor or the like arranged so as to act as a switching element. Feeding of an injection command pulse to the injector drive circuit permits the switching element of the injector drive circuit to be turned on, so that a drive current may be fed to the solenoid coil. This results in the valve of the injector being open, so that fuel fed from the fuel pump is injected into the fuel injection space of the engine through the injection port of the injector. The amount of fuel injected from the injector or a fuel injection quantity is determined depending on an injection period or a period of time during which the injection port is kept open and a pressure difference between a pressure of fuel fed from the fuel pump to the injector and a pressure in the fuel injection space or an atmospheric pressure. The pressure difference is referred to also as "fuel pressure" herein.

A time lag of a predetermined length exists between feeding of an injection command pulse to the drive circuit and actual opening of the valve of the injector. Likewise, a time lag exists between feeding of the injection command signal to the drive circuit and closing of the valve. This fails to permit a pulse width of the injection command pulse and an actual injection period or effective injection period to be equal to each other. A length of the effective injection period is determined depending on a pulse width of the injection command pulse. Thus, control of the pulse width of the injection command pulse permits the effective injection period to be controlled.

As noted from the above, the amount of fuel injected from the injector or a fuel injection quantity therefrom is determined depending on the fuel pressure and effective injection period. A variation in both fuel pressure and effective injection period causes the control to be complicated and/or troublesome. Thus, actually the fuel pressure is controlled so as to be substantially constant by the pressure regulator, resulting in the fuel injection quantity being determined essentially or directly depending on a pulse width of the injection command signal. Also, the pulse width of the injection command pulse is varied depending on various control conditions such as a degree of opening of a throttle valve, a rotational speed of the engine, an atmospheric pressure, a temperature of air sucked, a temperature of cooling water for the engine and the like, to thereby control the fuel injection quantity.

The pressure regulator functions to return fuel surplus in a passage defined between the fuel pump and an inlet of the injector toward the fuel tank to permit a fuel pressure at the inlet of the injector to be kept at a constant level when the fuel pressure exceeds a predetermined adjustment value.

The pressure regulator of this type tends to cause the adjustment value to be affected by a flow rate of the surplus fuel returned toward the fuel tank or a return flow rate of the surplus fuel. For example, the pressure regulator tends to cause the adjustment value to be substantially varied due to an excessive decrease or increase in return flow rate of the surplus fuel, to thereby be deteriorated in controllability thereof. Thus, in order to keep the fuel pressure substantially constant by means of the pressure regulator of this type, it is required that a return flow rate of the surplus fuel returned toward the fuel tank through the pressure regulator is kept within a suitable range or a range sufficient to ensure appropriate controllability of the pressure regulator.

As described above, in the fuel injection equipment, it is required to keep the fuel pressure at a predetermined level in order to permit the fuel injection quantity to be controlled depending on a pulse width of the injection command pulse. For this purpose, it is generally required that the amount of fuel to be fed to the injector is always increased as compared with the amount of fuel demanded by the internal combustion engine or a fuel demand of the engine and driving of the fuel pump is carried out so as to ensure that the amount of surplus fuel is kept within an appropriate range.

The conventional fuel pump drive apparatus which has been used for the internal combustion engine fed with fuel by means of the fuel injection equipment includes a magneto driven by the internal combustion engine and a battery charged through a battery charging circuit by means of a voltage induced across a battery charging coil arranged in the magneto and is constructed so as to continuously apply a voltage across the battery to the fuel pump during operation of the engine, to thereby drive the fuel pump. The voltage across the battery is applied to other loads as well as to the fuel pump.

The battery charging circuit is constituted by a rectification circuit for rectifying an AC voltage across the battery charging coil and a voltage regulator which functions to restrict a voltage applied to the battery to a predetermined level or below.

The voltage across the battery charged by an output of the magneto is not constant and is varied depending on a state of charging of the battery, a state of loads, a capability of a battery charging generator and the like. Thus, driving of the fuel pump by means of the voltage across the battery as in the conventional fuel pump drive apparatus causes the amount of fuel discharged from the fuel pump to be affected by a variation in voltage cross the battery, resulting in being varied. In particular, in the case that a load other than the fuel pump connected to the battery is a large-current load such as a tilt motor for an outboard motor, a horn, a head light, a motor for starting the internal combustion engine or the like, a voltage across the battery is substantially reduced, to thereby highly decrease the amount of fuel discharged from the fuel pump when the load is connected to the battery.

Thus, in the prior art, the fuel pump is designed or constructed so as to discharge fuel in an mount equal to or more than an expected maximum fuel demand of the internal combustion engine, when the voltage across the battery is reduced to a minimum level. Unfortunately, such construction causes the amount of fuel discharged from the fuel pump to be excessive, leading to an excessive increase in amount of fuel returned through the pressure regulator, resulting in controllability of the pressure regulator being deteriorated, when any load other than the fuel pump is separated from the battery to increase the voltage across the battery.

Such deterioration in control of a fuel pressure by the pressure regulator fails to permit the fuel injection quantity or the amount of injection of fuel to be determined essentially depending on a pulse width of the injection command pulse, leading to a failure in appropriate control of the amount of injection of fuel, so that the prior art substantially fail to derive desired performance of the internal combustion engine.

Also, when the fuel pump is driven by the battery, the fuel pump is required to exhibit excessive performance, leading to an excessive increase in power consumption of the fuel pump.

SUMMARY OF THE INVENTION

Accordingly, it is an object of the present invention to provide a fuel pump drive apparatus for a fuel injection equipment for an internal combustion engine which is capable of ensuring driving of a fuel pump for the fuel injection equipment so as to permit the fuel pump to effectively discharge fuel in an amount required while being kept from being substantially affected by a variation in voltage across a battery due to connection of a large-current load to the battery.

In accordance with the present invention, a fuel pump drive apparatus for a fuel injection equipment for an internal combustion engine is provided. The fuel pump drive apparatus includes a battery charging coil and a pump drive coil arranged in a magneto driven by the internal combustion engine, a battery charged through a battery charging circuit by means of an output of the battery charging coil, a pump drive circuit including a rectification circuit for rectifying an output voltage of the pump drive coil and a voltage regulator for restricting an output voltage of the rectification circuit to an adjustment value or less and constructed so as to apply a DC voltage restricted to the adjustment value or less to a power terminal of a fuel pump of the fuel injection equipment for the internal combustion engine, and a battery voltage feed circuit including a voltage application control means turned off when an output voltage of the pump drive circuit is higher than a voltage across the battery and turned on when the output voltage of the pump drive circuit is lower than the voltage across the battery and constructed so as to apply the voltage across the battery to the power terminal of the fuel pump through the voltage application control means. The adjustment value of the voltage regulator of the pump drive circuit is set to be higher than a maximum value of the voltage across the battery.

The above-described construction of the present invention permits the output voltage of the pump drive coil to be reduced and the output voltage of the pump drive circuit to be lower than the voltage across the battery during starting of the internal combustion engine, so that a voltage is applied from the battery through the voltage application control means to the fuel pump. During the starting, the amount of fuel required by the engine or a fuel demand of the engine is reduced, so that a decrease in voltage across the battery to a minimum value does not cause deficiency of fuel discharged from the fuel pump.

When the output voltage of the pump drive coil is increased to cause the output voltage of the pump drive circuit to exceed the output voltage of the battery after starting of the internal combustion engine, a voltage is applied from the pump drive coil through the pump drive circuit to the fuel pump. The adjustment value of the voltage regulator of the pump drive circuit is set to be higher than a maximum value of the voltage across the battery; so that when a rotational speed of the engine is increased to cause the output voltage of the pump drive coil to exceed the adjustment value of the voltage regulator after starting of the engine, the output voltage of the pump drive circuit is applied to the fuel pump irrespective of the voltage across the battery, to thereby permit a voltage equal to or higher than a maximum value of the voltage across the battery to be applied to the fuel pump. Thus, the fuel pump is merely required to discharge fuel in an amount equal to or more than a maximum fuel demand of the engine when a voltage equal to or higher than a maximum value of the voltage across the battery is applied to the fuel pump. This means that the fuel pump is not required to discharge fuel in an amount equal to or more than the maximum fuel demand of the engine when the voltage across the battery is at a level of a minimum value thereof unlike the prior art, resulting in preventing power consumption of the fuel pump from being excessive.

Also, the fuel pump may be driven by means of the output voltage of the pump drive circuit kept from being affected by condition of the battery. The output voltage is kept at the adjustment value during steady operation of the internal combustion engine, so that a load of the battery may be reduced to a degree sufficient to prevent excessive discharge of fuel from the fuel pump even when the voltage across the battery is increased. This permits a control pressure of the pressure regulator to be kept constant with respect to each of fuel demands of the internal combustion engine when the fuel demand of the engine is not varied, because the amount of fuel returned to the fuel tank through the pressure regulator is rendered constant. This effectively prevents a control pressure of the pressure regulator from being substantially varied due to a variation in voltage across the battery, resulting in the amount of fuel fed to the engine being controlled with increased accuracy.

The pump drive coil is preferably constructed so as to generate a voltage equal to or higher than the adjustment value of the voltage regulator of the pump drive circuit during idling of the internal combustion engine.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a fuel pump drive apparatus for a fuel injection equipment for an internal combustion engine according to the present invention will be described hereinafter with reference to the accompanying drawings.

Figure 1:
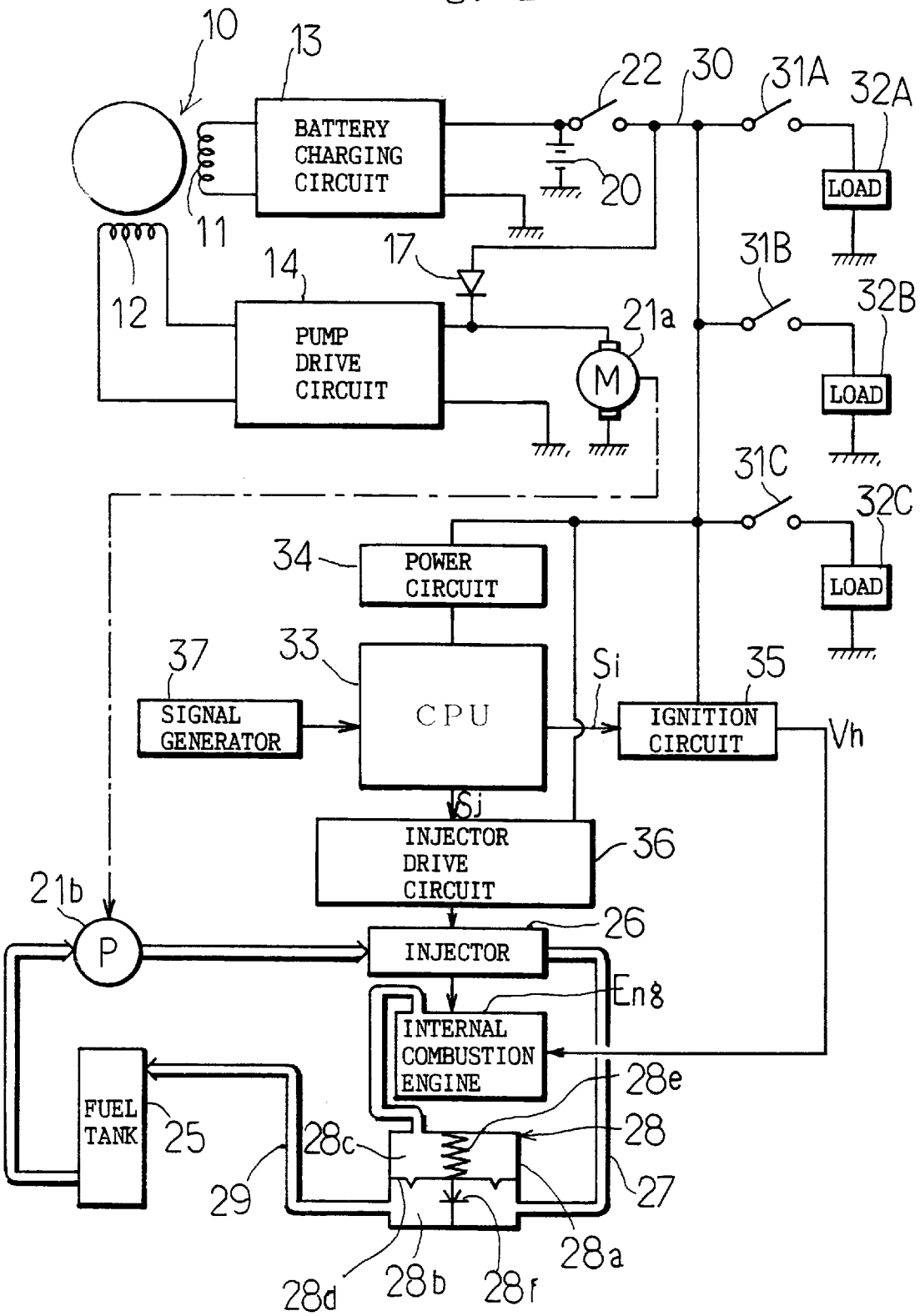
FIG. 1 is a circuit diagram showing an embodiment of a fuel pump drive apparatus for a fuel injection equipment for an internal combustion engine according to the present invention.

Referring first to FIG. 1, an embodiment of a fuel pump drive apparatus for a fuel injection equipment for an internal combustion engine according to the present invention is illustrated. In FIG. 1, reference numeral 10 designates a magneto driven by an internal combustion engine Eng, which magneto is constituted by a magnet rotor mounted on an output shaft of the internal combustion engine and a stator fixed on a casing of the internal combustion engine or the like and includes a battery charging coil 11 and a pump drive coil 12 which are arranged on a side of the stator. The battery charging coil 11 and pump drive coil 12 generate AC voltages alternating with each other in synchronism with rotation of the internal combustion engine. The AC voltage induced across each of the battery charging coil 11 and pump drive coil 12 has a crest value increased with an increase in rotational speed of the internal combustion engine.

The AC voltage outputted by the battery charging coil 11 is inputted to a battery charging circuit 13, whereas the AC voltage outputted by the pump drive coil 12 is inputted to a pump drive circuit 14.

The battery charging circuit 13 is constituted by a rectification circuit for rectifying an AC output of the battery charging coil 11 and a voltage regulator functioning to keep an output voltage of the rectification circuit at a predetermined level or below and may be constructed in such a manner as known in the art. The battery charging circuit 13 has an output terminal on a positive polarity side thereof or a positive output terminal connected to a positive output of a battery 20 and an output terminal on a negative polarity side thereof or a negative output terminal grounded. The battery 20 has a negative terminal connected to the negative output terminal of the battery charging circuit 13 through a grounded circuit.

The pump drive circuit 14 includes a rectification circuit for rectifying an AC voltage induced across the pump drive coil 12 and a voltage regulator functioning to keep an output voltage of the rectification circuit at an adjustment value or less and is constructed so as to output a DC voltage restricted to the adjustment value or less. The pump drive circuit 14 has a positive output terminal connected to a positive power input terminal of a pump drive motor 21*a*. A negative output terminal of the pump drive circuit 14 and a negative power input terminal of the pump motor 21*a* are grounded.

The fuel pump drive apparatus of the illustrated embodiment is provided with a diode 17 which has a cathode connected to the positive output terminal of the pump drive circuit 14 and an anode coupled to the positive terminal of the battery 20 through a power switch 22.

The diode 17 is biased in a forward direction or forwardly or a forward voltage is applied across the diode 17 only when a voltage across the battery 20 is higher than an output voltage of the pump drive circuit 14, so that the diode 17 is turned on. Thus, the voltage across the battery is applied to the pump drive motor 21*a* through the diode 17 only when the diode 17 is forwardly biased.

In the illustrated embodiment, the diode 17 provides a voltage application control means which is turned off when an output voltage of the pump drive circuit 14 is higher than a voltage across the battery 20 and turned on when the output voltage of the circuit 14 is lower than the voltage thereacross. Also, a circuit extending from the battery 20 through the diode 17 to the output terminal of the pump drive circuit 14 constitutes a battery voltage feed circuit.

Also, in the illustrated embodiment, the battery charging coil 11 and pump drive coil 12 arranged in the magneto 10, the battery charging circuit 13, the pump drive circuit 14, the diode 17, the battery 20, and the power switch 22 cooperate with each other to constitute the fuel pump drive apparatus of the illustrated embodiment.

The fuel pump includes a pump mechanism 21*b* driven by the pump motor 21*a*, wherein the pump mechanism 21*b* functions to pump up fuel stored in a fuel tank 25 and discharge it to a pipeline connected to a fuel inlet of an injector 26.

The injector 26 may be constructed in a manner known in the art and includes an injection port open to a fuel injection space of the internal combustion engine such as, for example, an interior of an air inlet or intake pipe thereof or the like, a needle valve for selectively closing the injection port, and a solenoid or electromagnet for actuating the needle valve, wherein feeding of a drive current to the solenoid permits the needle valve to be open to inject fuel from the injection port. The injector 26 includes a fuel outlet port through which surplus fuel is discharged therefrom. The fuel outlet port is connected to a pressure regulator 28 through a pipeline 27.

The pressure regulator 28 includes a housing 28*a* which is provided therein with a fuel chamber 28*b* and a spring chamber 28*c*. The fuel chamber 28*b* and spring chamber 28*c* are partitioned from each other through a diaphragm 28*d*, which is urged toward the fuel chamber 28*b* by means of a spring 28*e* arranged in the spring chamber 28*c*. The fuel chamber 28*b* is provided therein with a valve 28*f* for selectively interrupting communication between an inlet of the fuel chamber 28*b* and an outlet thereof. The valve 28*f* is connected on a movable side thereof to the diaphragm 28*d*. Also, the valve 28*f* is constantly urged in a direction of closing thereof by the spring 28*e*. The fuel chamber 28*b* is connected at the inlet thereof to the piping 27 kept at a pressure identical with a pressure on a side of the fuel inlet port of the injector 26. Also, the fuel chamber 28*b* is connected at the outlet thereof to the fuel tank 25 through a return pipe 29. In the illustrated embodiment, the spring chamber 28*c* is arranged so as to communicate with the fuel injection space of the internal combustion engine Eng such as, for example, an interior of the air intake pipe thereof or the like.

The battery 20 has various loads connected thereto which are associated with units driven by the internal combustion engine. In the illustrated embodiment, a terminal of the power switch 22 opposite to the battery 20 acts as a load connection terminal 30, which is connected through load drive switches 31A, 31B and 31C to non-grounded terminals of electrically and/or electronically driven units or parts (hereinafter referred to as "electrical parts") or loads 32A, 32B and 32C, respectively. An equipment driven by the internal combustion engine is an automobile or a motorcycle, the loads 32A to 32C include a horn, a head light, a direction indicator and the like. When it is an outboard motor, the loads include a tilt motor for tilting the outboard motor when it runs ashore and the like.

The load connection terminal 30 is connected to a non-grounded input terminal of a power circuit 34 for applying a power voltage to a CPU 33 of a microcomputer and a non-grounded power input terminal of an ignition circuit 35 controlled by the CPU 33, as well as to a non-grounded power input terminal of an injector drive circuit 36 likewise controlled by the CPU 33.

The power circuit 34 functions to drop a voltage of the battery 20 to generate a DC constant voltage suitable for driving the CPU 33. The CPU 33 functions to operate an ignition position at each of rotational speeds of the internal combustion engine Eng based on rotational angular information of the internal combustion engine Eng and rotational speed information thereof obtained from an output of a signal generator 37 which generates a pulse signal at a predetermined rotational angular position of the engine, resulting in feeding the ignition circuit 35 with an ignition signal Si at the ignition position thus operated.

The ignition circuit 35 shown in FIG. 1 is constituted by a circuit of the capacitor discharge type operated using a boosting circuit for increasing a voltage across the battery 20 or a DC converter circuit as a power supply therefor and is adapted to rapidly vary a primary current of an ignition coil to generate a high voltage Vh for ignition when it is fed with the ignition signal Si from the CPU 33. The high voltage Vh thus generated is then applied to an ignition plug mounted on a cylinder of the internal combustion engine Eng. The ignition plug generates sparks to ignite the engine when the high voltage Vh is applied thereto.

Alternatively, the ignition circuit 35 may be constituted by a circuit of the current interruption type operated using the battery 20 as a power supply therefor, a circuit of the capacitor discharge type operated using an exciter coil arranged in the magneto 10 as a power supply therefor or the like.

The CPU 33 has information such as a degree of opening of a throttle valve detected by a sensor (not shown), an atmospheric pressure, a temperature of the engine, an atmospheric temperature and the like inputted thereto. The CPU 33 operates both a fuel injection position or a position at which fuel injection is started and a fuel injection period based on the information thus inputted and the above-described rotational angular information and rotational speed information of the engine obtained from the output of the signal generator 37, resulting in feeding the injector drive circuit 36 with an injection command pulse signal Sj having a pulse width corresponding to the fuel injection period operated at the fuel injection position operated. The injector drive circuit 36 includes a switch element such as a transistor or the like which is kept turned on while the injection command pulse signal Sj is fed thereto. The injector drive circuit 36 acts to feed a drive current to the solenoid coil of the injector 26 while the switch element is kept turned on.

In the apparatus shown in FIG. 1, the power switch 22 may be constituted by a switch (key switch) operated through key operation. Turning-on of the power switch 22 permits a power voltage to be applied from the battery 20 through the power circuit 34 to the CPU 33, leading to rising of the CPU 33. Also, the voltage across the battery 20 is applied to the pump drive motor 21*a* through the power switch 22 and diode 17, so that the pump drive motor 21*a* may be rotated to feed fuel to the injector 26. When starting operation of the internal combustion engine takes place, the CPU 33 operates an ignition position to generate an ignition signal Si and operates a fuel injection position and a fuel injection period to generate an injection command pulse Sj.

Generation of the injection command signal Sj permits the injector drive circuit 36 to feed the injector 26 with a drive current, leading to injection of fuel from the injector 26. Also, generation of the ignition signal Si results in the ignition circuit 35 generating a high voltage Vh, so that the engine is ignited, to thereby be started.

Figure 8:
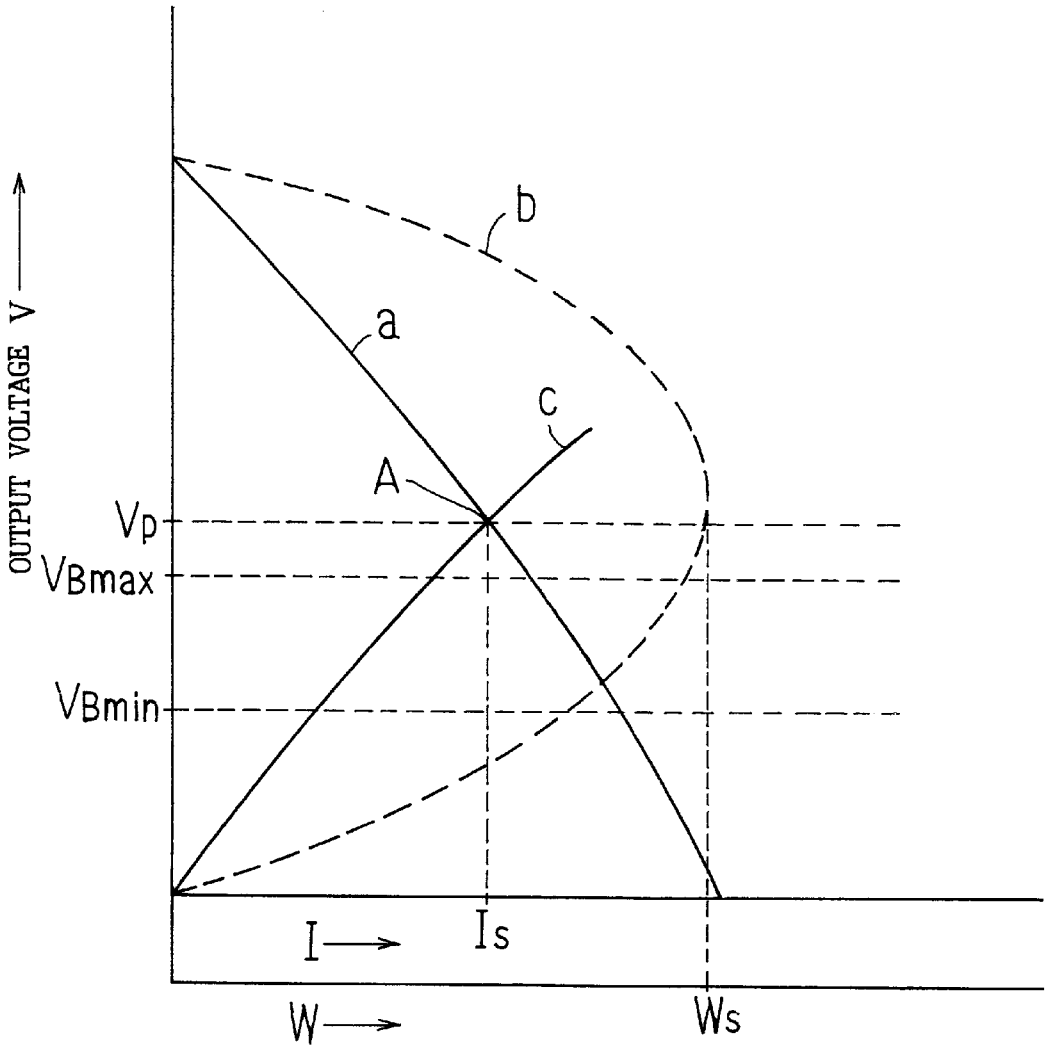
FIG. 8 is a graphical representation showing characteristics of a generator and a load curve of a pump drive motor which are suitable for incorporation in a fuel pump drive apparatus of the present invention.

FIG. 8 shows output characteristics of the pump drive coil 12 suitable for incorporation in the illustrated embodiment together with a load curve of the pump drive motor 21*a* by way of example. In FIG. 8, an axis of ordinates represents a voltage V and an axis of abscissas represents a current I and an output W. Also, in FIG. 8, a curve a indicates output voltage V-output current I characteristics of the pump drive coil 12 obtained while the engine is rotated at a rotational speed during idling thereof. A curve b indicates output voltage V-output W characteristics thereof during idling of the engine and a curve c indicates a load curve of the pump drive motor (DC motor) 21*a*. The pump drive motor 21*a* is actuated or rotated at an operation point defined by an intersection A between the curves a and c. At this time, a rated voltage Vp is applied across the pump drive motor 21*a*, so that the pump drive coil 12 generates an output Ws. The fuel pump is designed or constructed so as to discharge fuel in an amount equal to or above a maximum fuel quantity demanded by the internal combustion engine or a maximum fuel demand of the engine while the rated voltage Vp is applied to the pump drive motor 21*a*. In FIG. 8, reference character VBmin indicates an estimated or expected minimum value of the voltage across the battery 20 and VBmax is an expected maximum value thereof.

In the illustrated embodiment, as shown in FIG. 8, the rated drive voltage Vp of the fuel pump is set to be slightly higher than the maximum value VBmax of the voltage across the battery 20 and the characteristics of the pump drive coil 12 are so set that the pump drive coil may generate a voltage equal to or higher than the rated drive voltage Vp of the pump drive motor 21*a* while the internal combustion engine is rotated at a rotational speed equal to or higher than that during idling thereof. Also, the adjustment value of the voltage regulator provided for the pump drive circuit 14 is set to be equal to the rated drive voltage Vp of the fuel pump, so that a voltage applied to the pump drive motor 21*a* while the engine is rotated at a rotational speed equal to or higher than that during idling thereof is kept at a level of the rated voltage Vp.

Such setting permits the voltage across the battery 20 to be applied to the pump drive motor 21*a* through the diode 17 because the output voltage of the pump drive coil 12 is lower than the voltage across the battery 20. When the internal combustion engine is provided with a motor for starting, the starting motor acts as an increased load during starting of the engine, to thereby cause the voltage across the battery 20 to be reduced to a level near the minimum value VBmin, so that the pump drive motor 21*a* would be driven by the minimum voltage of the battery. This causes a decrease in the amount of fuel discharged from the fuel pump during starting of the engine, however, such a decrease does not substantially cause any problem because the amount of fuel required by the engine during starting of the engine is reduced. After starting of the engine, the characteristics shown in FIG. 8 permit the pump drive coil 12 to constantly generate a voltage equal to or higher than the rated drive voltage Vp of the fuel pump. Also, the pump drive circuit 14 generates the rated drive voltage Vp. Thus, the amount of fuel discharged from the fuel pump is kept at a substantially constant level.

Figure 9:
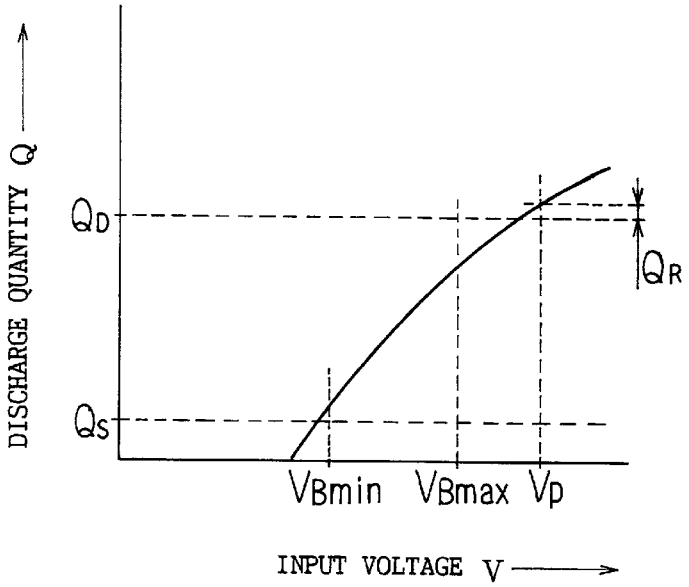
FIG. 9 is a graphical representation showing characteristics of a fuel pump suitable for incorporation in a fuel pump drive apparatus of the present invention by way of example.

FIG. 9 shows relationship between an input voltage V of the fuel pump suitable for incorporation in the apparatus of the illustrated embodiment and a fuel discharge quantity Q thereof, wherein reference character $Q_D$ indicates a maximum fuel demand of the internal combustion engine or the amount of fuel injected from the injector and $Q_s$ is a fuel demand of the engine during starting thereof. In the illustrated embodiment, the pump is set so as to discharge fuel in an amount increased by a required minimum surplus $Q_R$ as compared with the maximum fuel demand $Q_D$ of the engine while the rated drive voltage Vp is applied to the fuel pump. After starting of the engine, a voltage applied to the fuel pump is kept at a level of the rated drive voltage Vp, so that the amount of fuel discharged from the pump is kept constant ($Q=Q_D+Q_R$).

Figure 10:
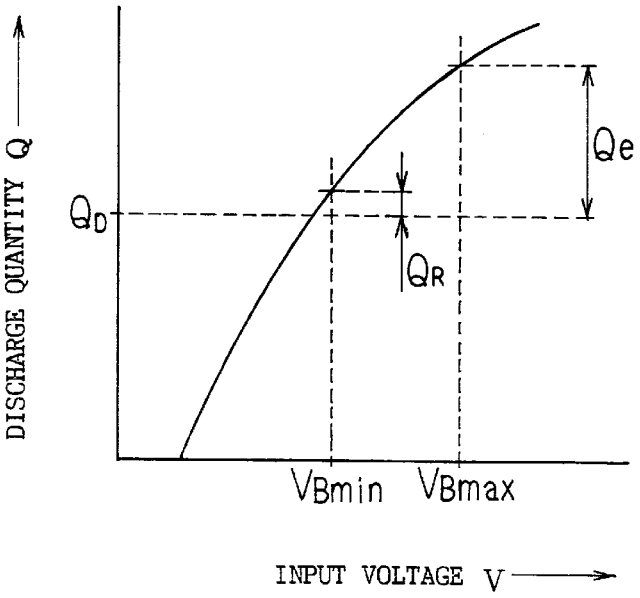
FIG. 10 is a graphical representation showing characteristics of a fuel pump when it is incorporated in a conventional fuel pump drive apparatus.

FIG. 10 shows characteristics of the fuel pump required when the fuel pump is driven by the conventional fuel pump drive apparatus described above which is constructed so as to continue application of a voltage across the battery to the fuel pump during operation of the internal combustion engine. In this instance, it is required to design the fuel pump so that it may discharge fuel in an amount increased by the predetermined surplus $Q_R$ as compared with the maximum fuel demand $Q_D$ of the engine when the voltage across the battery is at a level of the minimum value VBmin. Such construction causes the fuel discharge quantity of the pump to be substantially varied with a variation in voltage across the battery, leading to an excessive increase in surplus Qe of fuel when the voltage across the battery reaches a level of the maximum value VBmax.

Figure 11:
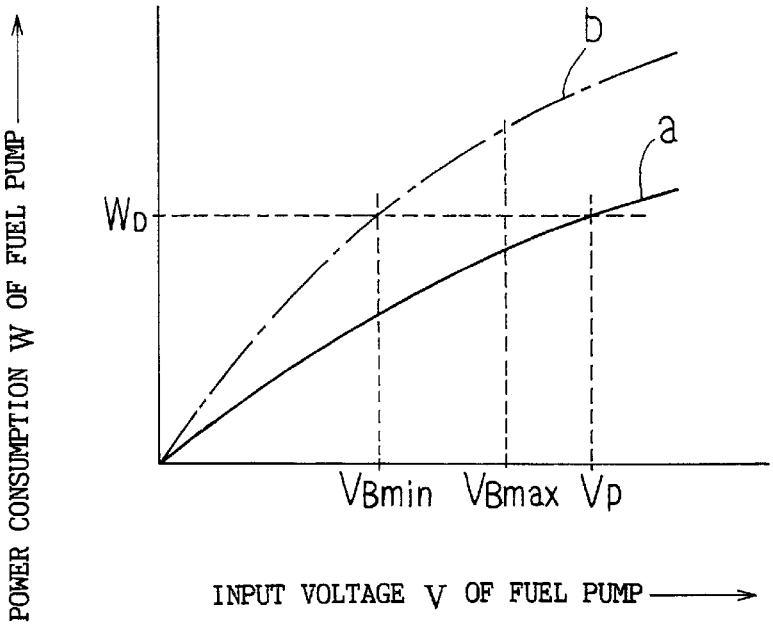
FIG. 11 is a graphical representation showing an electric power consumed by a fuel pump incorporated in a fuel pump drive apparatus according to the present invention and that incorporated in a conventional one while comparing both with each other.

Relationship between an electric power W consumed by the fuel pump having the characteristics shown in FIG. 9 and an input voltage V thereof which is obtained when the fuel pump is driven by the power supply according to the present invention is indicated at a curve a in FIG. 11 by way of example; whereas a curve b indicates relationship therebetween obtained when the voltage across the battery is constantly applied to the fuel pump exhibiting characteristics shown in FIG. 10 as in the conventional fuel pump drive apparatus. Thus, it will be noted that the fuel pump drive apparatus of the illustrated embodiment is substantially reduced in power consumption as compared with the conventional one.

Figure 12:
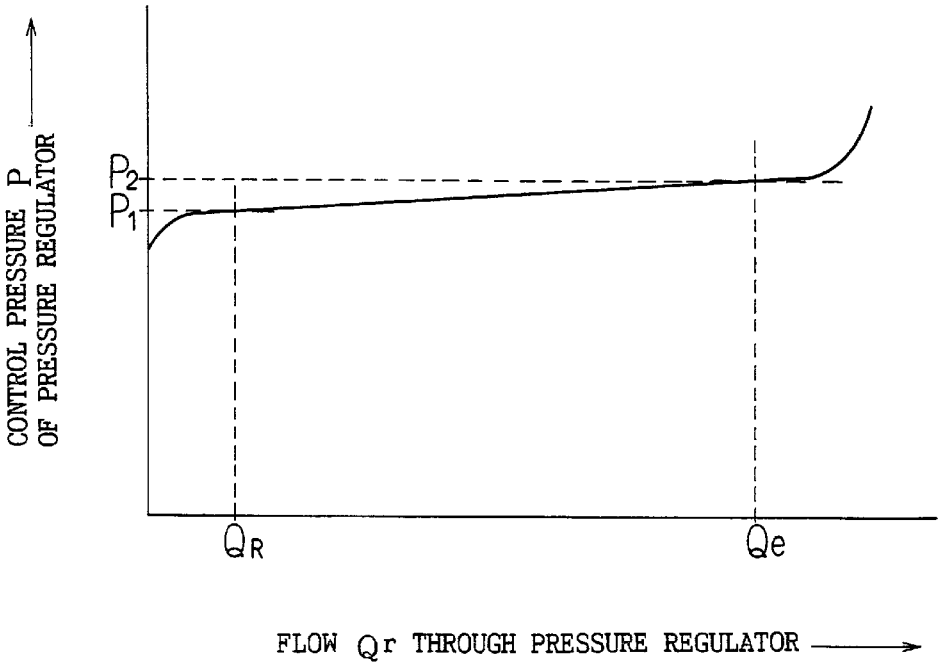
FIG. 12 is a graphical representation showing control characteristics of a pressure regulator by way example.

FIG. 12 shows relationship between the amount Qr of a surplus fuel returned through the pressure regulator 28 toward the fuel tank 25 and a control pressure P of the pressure regulator 28 by way of example. In FIG. 12, reference character $Q_R$ is such a surplus as described above with reference to FIGS. 9 and 10 and Qe is such a surplus as described above with reference to FIG. 10.

As will be noted from FIG. 12, the control pressure of the pressure regulator 28 is varied depending on the amount of fuel passing through the pressure regulator. For example, the control pressure is varied from P1 to P2 when the amount of surplus fuel passing through the pressure regulator 28 or the surplus fuel quantity through the regulator is varied from the surplus $Q_R$ to the surplus Qe.

When the voltage across the battery 20 is constantly applied to the fuel pump as in the conventional fuel pump drive apparatus, the voltage is varied from the minimum value VBmin to the maximum value VBmax when a load other than the fuel pump is connected to or separated from the battery, so that the surplus fuel quantity through the regulator 28 is varied from the surplus $Q_R$ to the surplus Qe with such a variation in voltage, resulting in a pressure of fuel fed to the injector being varied between levels P1 and P2 irrespective of the fuel demand of the internal combustion engine.

On the contrary, the fuel pump drive apparatus of the illustrated embodiment permits the fuel surplus to be constant when the fuel demand of the engine is constant, so that the surplus fuel quantity through the pressure regulator 28 is rendered constant, resulting in the control pressure being kept constant. Thus, the illustrated embodiment permits the fuel pump to be driven by a constant voltage unrelated to the voltage across the battery after starting of the engine, so that a pressure of fuel fed to the injector may be kept constant with respect to each of the fuel demands of the engine, resulting in the fuel injection quantity being controlled with high accuracy.

The embodiment shown in FIG. 1, as described above, is so constructed that the spring chamber 28*c* of the pressure regulator 28 is connected to the fuel injection space of the internal combustion engine such as, for example, an interior of the air intake pipe thereof, resulting in a pressure difference between a pressure of fuel fed to the injector from the fuel pump and a pressure in the fuel injection space being kept at a predetermined level. However, the illustrated embodiment is not restricted to such construction. It may be constructed so as to keep a pressure difference between a pressure of fuel fed from the fuel pump to the injector and an atmospheric pressure at the predetermined level by means of the pressure regulator. For example, when the injector is individually mounted on each of cylinders of a multicylinder internal combustion engine to inject fuel directly into each of the cylinders, the pressure regulator is subject to operation while keeping the spring chamber thereof open to an ambient atmosphere, because the fuel injection spaces are different from each other depending on the cylinders. In this instance, the pressure regulator 28 is controlled so as to keep a pressure difference between a pressure of fuel fed from the fuel pump to the injector and an atmospheric pressure at the predetermined level.

Now, the battery charging circuit 13 and pump drive circuit 14 suitable for incorporation in the fuel pump drive apparatus shown in FIG. 1 will be described hereinafter with reference to FIGS. 2 and 3 by way of example, respectively.

Figure 2:
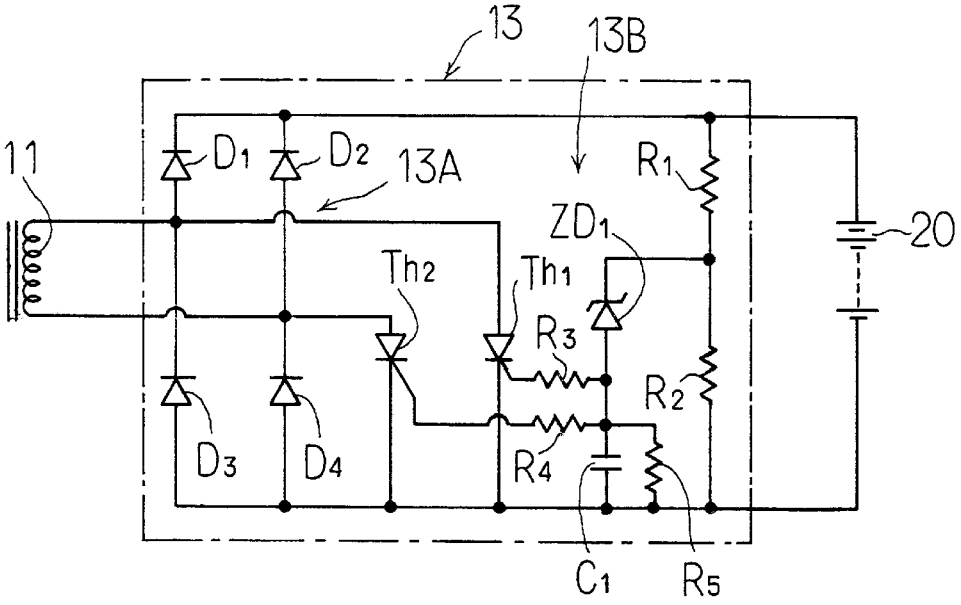
FIG. 2 is a circuit diagram showing a battery charging circuit incorporated in the fuel pump drive apparatus of FIG. 1.

The battery charging circuit 13 shown in FIG. 2 is constituted by a circuit in which diodes D1 to D4 are subject to bridge connection and includes a full-wave rectification circuit 13A for rectifying an output voltage of the battery charging coil 11, a voltage dividing circuit constituted by a series circuit of resistors R1 and R2 connected across a DC output terminal of the rectification circuit 13A, thyristors Th1 and Th2 of which anodes are respectively connected to one end of the battery charging coil 11 and the other end thereof and cathodes are commonly connected to a negative output terminal of the rectification circuit 13A, a Zener diode ZD1 of which a cathode is connected to a connection between resistors R1 and R2 or an output terminal of the voltage dividing circuit, resistors R3 and R4 respectively connected between the anode of the Zener diode ZD1 and gates of the thyristors Th1 and Th2, and a parallel circuit of a capacitor C1 and a resistor R5 each connected to a common connection between the anode of the Zener diode ZD1 and the cathodes of the thyristors Th1 and Th2.

In the battery charging circuit 13 of FIG. 2 thus constructed, the voltage dividing circuit constituted by the series circuit of the resistors R1 and R2 provides an output voltage detection circuit for detecting an output voltage of the rectification circuit 13A. Also, the thyristors Th1 and Th2 constitutes a generator output short-circuiting switch circuit for short-circuiting an output of the battery charging coil 11, which is turned on when it is triggered. Further, the Zener diode ZD1, resistors R3 to R5 and capacitor C1 cooperate with each other to provide an output short-circuiting switch trigger circuit which functions to feed the generator output short-circuiting switch circuit with a trigger signal to turn on the switch circuit when a detected value of an output voltage of the rectification circuit 13A exceeds a predetermined level.

The output voltage detection circuit, generator output short-circuiting switch circuit and output short-circuiting switch trigger circuit cooperate together to constitute a voltage regulator 13B which functions to restrict an output voltage of the battery charging circuit to a predetermined level or below.

In the battery charging circuit shown in FIG. 2, an AC voltage outputted by the battery charging coil 11 is rectified by the rectification circuit 13A and then applied across the battery 20. When the voltage across the battery 20 exceeds the predetermined level, the Zener diode ZD1 is turned on to feed the thyristors Th1 and Th2 with a trigger signal, so that of the thyristors Th1 and Th2, one in which a forward voltage is applied across an anode-cathode circuit thereof is turned on, resulting in the output of the battery charging coil 11 being short-circuited through a path circulatingly extending from the coil 11 through the thyristor Th1 and diode D4 to the coil 11 or a path likewise extending from the coil 11 through the thyristor Th2 and diode D3 to the coil 11. This leads to a decrease in output of the battery charging coil 11, so that the voltage across the battery is restricted to the predetermined level or below. The predetermined level of the voltage regulator of the battery charging circuit 13 is set to be equal to the maximum voltage VBmax of the battery 20.

Figure 3:
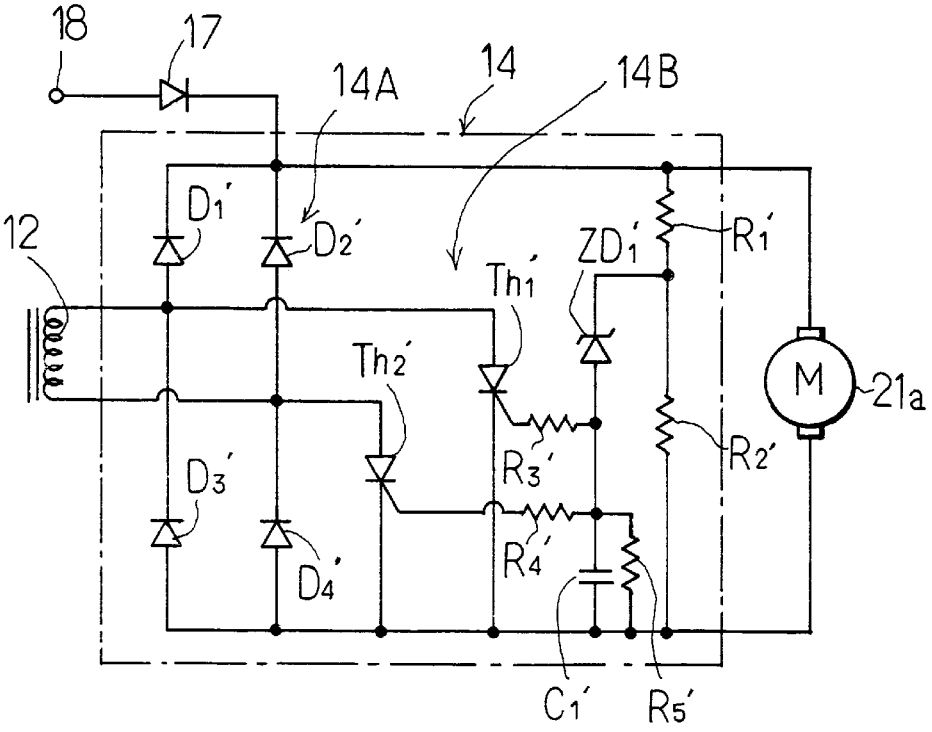
FIG. 3 is a circuit diagram showing a pump drive circuit incorporated in the fuel pump drive apparatus of FIG. 1.

The pump drive circuit 14 shown in FIG. 3 is constructed of a rectification circuit 14A including diodes D1' to D4', as well as a voltage regulator 14B constituted by a generator output short-circuiting switch circuit including thyristors Th1' and Th2', an output voltage detection circuit including resistors R1' and R2', and an output short-circuiting switch trigger circuit including a Zener diode ZD1', resistors R3' to R5' and a capacitor C1'. Thus, the pump drive circuit 14 is constructed in substantially the same manner as the battery charging circuit 13 shown in FIG. 2. The voltage regulator 14B of the pump drive circuit 14 shown in FIG. 3 functions to control an output voltage thereof applied to the pump drive motor 21*a* so that the output voltage is restricted to an adjustment value Vp equal to or less than a rated drive voltage of the pump drive motor.

In the illustrated embodiment, in order to prevent flowing of a drive current from the battery to the fuel pump, to thereby ensure interruption of the fuel pump, a battery voltage feed circuit is preferably constructed by arranging a switch means closed only during operation of the internal combustion engine in addition to a voltage application control means, resulting in a voltage across the battery being applied across the fuel pump through both switch means and voltage application control means. In the illustrated embodiment, the voltage application control means is constituted by the diode 17 and the switch means is constituted by the power switch 22.

In the embodiment shown in FIG. 1, the power switch 22 is constructed so as to serve as the switch means closed only during operation of the internal combustion engine. Alternatively, the switch means may comprise a switch which is constructed so as to detect rotation of the internal combustion engine, to thereby be kept turned on only while the engine is rotated.

The switch turned on upon detection of rotation of the internal combustion engine may be constituted by, for example, a semiconductor switch incorporated in a circuit for flowing a drive current to the fuel pump and a switch control circuit for controlling the semiconductor switch in a manner to detect an output generated by a magneto or a signal generator mounted on the internal combustion engine due to starting operation of the engine, to thereby turn on the semiconductor switch and turn off the semiconductor switch when the magneto or signal generator interrupts generation of the output due to interruption of the engine.

Figure 4:
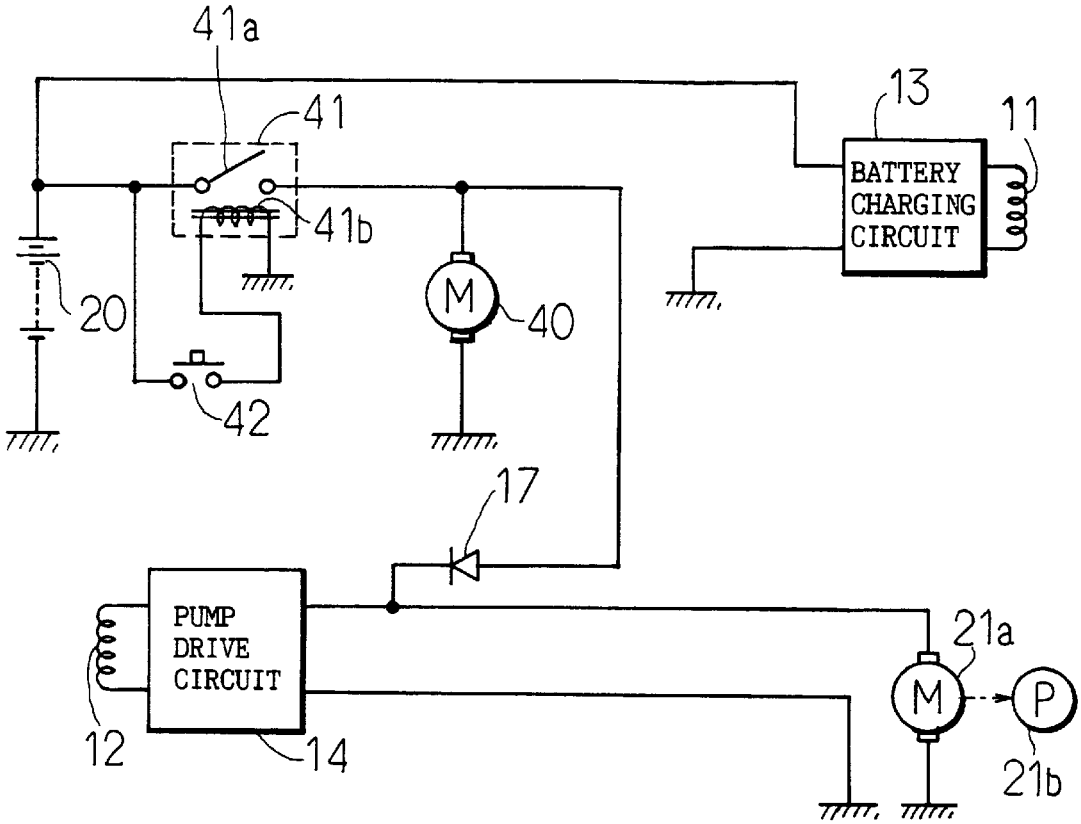
FIG. 4 is a circuit diagram showing another embodiment of a fuel pump drive apparatus for a fuel injection equipment for an internal combustion engine according to the present invention.

Referring now to FIG. 4, another embodiment of a fuel pump drive apparatus for a fuel injection equipment for an internal combustion engine according to the present invention is illustrated. In an internal combustion engine for driving a watercraft which is a water vehicle driven by an internal combustion engine such as a boat, a water ski, a water scooter or the like, a battery is often connected directly to a starting motor without interposing a power switch therebetween. A fuel pump drive apparatus of the illustrated embodiment is adapted to be applied to such a situation. More particularly, in the illustrated embodiment, a starter relay 41 is arranged so as to serve as an engine starting switch closed when an engine starting motor 40 for starting of the internal combustion engine is driven. The starter relay 41 has a contact 41*a* connected at one end thereof to a positive terminal of a battery 20. The contact 41*a* is also connected at the other end thereof to a power input terminal of the engine starting motor 40 on a non-grounded side thereof, of which a power input terminal on a grounded side thereof is grounded. The starter relay 41 includes an exciting coil 41*b* grounded at one end thereof and connected at the other end thereof through a manual operation switch 42 to the positive terminal of the battery 20. In the illustrated embodiment, a diode 17 constituting a voltage application control means is connected at an anode thereof through the contact 41*a* of the starter relay 41 to the positive terminal of the battery 20. The remaining part of the illustrated embodiment may be constructed in substantially the same manner as the embodiment described above with reference to FIG. 1. A fuel pump connected to the battery and electric parts other than the starting motor which act as loads are not shown in FIG. 2 for the sake of brevity.

In the embodiment shown in FIG. 4, the switch 42 comprises a momentary switch closed only when it is manually operated. The exciting coil 41*b* of the starter relay 41 is excited while the switch 42 is closed, so that the contact 41*a* is closed to apply a voltage from the battery 20 to the starting motor 40. This permits the starting motor 40 to be rotated, leading to starting of the internal combustion engine. When the manual operation switch 42 is released from force exerted thereon after starting of the engine, the contact 41*a* of the starter relay 41 is rendered open, so that operation of the starting motor 40 is interrupted.

In the embodiment shown in FIG. 4, the voltage across the battery 20 is applied across an output terminal of the pump drive circuit through the diode 17 only while the contact 41*a* of the starter relay 41 is closed during starting of the internal combustion engine, so that a voltage is applied to a pump motor 21*a* by means of the voltage across the battery 20. After starting of the engine, the contact 41*a* is rendered open, so that the voltage across the battery 20 is kept from being applied across the output terminal of the pump drive circuit 14.

In the illustrated embodiment, as described above, the battery voltage feed circuit is constructed so as to permit the voltage across the battery to be applied across a power terminal of the fuel pump through the voltage application control means, which comprises the diode 17 in the illustrated embodiment, turned off when the output voltage of the pump drive circuit is higher than the voltage across the battery 20 and turned on when the former voltage is lower than the latter voltage and also through the switch, which comprises the starter switch 41 in the illustrated embodiment, closed only during starting of the internal combustion engine. Such construction permits the voltage across the battery to be applied to the fuel pump only during starting of the internal combustion engine and the pump drive circuit to exclusively apply a voltage to the fuel pump after the engine is started once, so that the fuel pump may be prevented from being affected by a variation in voltage across the battery irrespective of a rotational speed of the internal combustion engine during operation of the engine. Thus, in this instance, it is not required to set the adjustment value of the voltage regulator of the pump drive circuit at a level equal to or higher than the maximum value VBmax of the voltage across the battery 20, so that the adjustment value of the voltage regulator may be set at any level suitable for permitting the fuel pump to provide a desired fuel discharge quantity which is the sum of the maximum fuel demand of the engine and the predetermined fuel surplus or any level suitable for permitting the pump motor to provide the desired fuel discharge quantity while being decreased in size as much as possible and reduced in power consumption.

Use of the diode 17 for the voltage application control means which is turned off when the output voltage of the pump drive circuit 14 is higher than the voltage across the battery and turned on when the former voltage is lower than the latter voltage as in the illustrated embodiment leads to simplification in structure of the fuel pump drive apparatus.

However, in the present invention, the voltage application control means is not limited to the diode 17. For example, the voltage application control means may comprise a switch circuit which is turned on to permit the voltage across the battery to be applied across the output terminal of the pump drive circuit when the voltage across the output terminal of the pump drive circuit is lower than the voltage across the battery and turned off to separate the battery from the output terminal of the pump drive circuit when the former voltage is higher than the latter voltage. The switch circuit may be either a switch circuit having a semiconductor incorporated therein or a relay.

The switch circuit constituting the voltage application control means may be constituted, for example, by a battery voltage detection circuit for detecting a voltage across a battery connection output terminal of the battery charging circuit 13, a pump drive voltage detection circuit for detecting a voltage across a pump connection output terminal of the pump drive circuit 14, a comparison circuit for comparing a detection output of the battery voltage detection circuit and a detection output of the pump drive voltage detection circuit with each other to generate an output varied depending on a difference between both detection outputs, and a switch element which is subject to on-off control depending on an output of the comparison circuit so as to be turned off when the detection output of the pump drive voltage detection circuit is higher than that of the battery voltage detection circuit and turned on when the former output is lower than the latter output.

Figure 5:
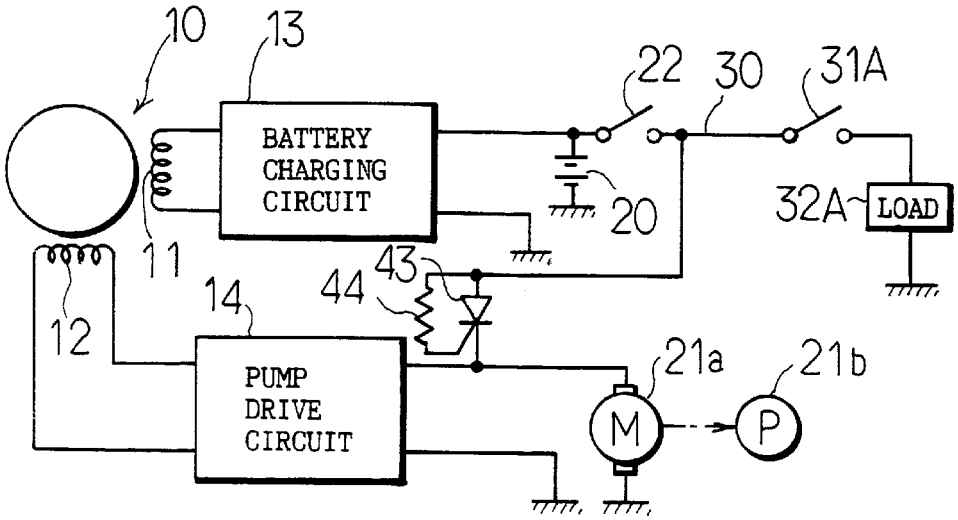
FIG. 5 is a circuit diagram showing a further embodiment of a fuel pump drive apparatus for a fuel injection equipment for an internal combustion engine according to the present invention.

Referring now to FIG. 5, a further embodiment of a fuel pump drive apparatus for a fuel injection equipment for an internal combustion engine according to the present invention is illustrated. In a fuel pump drive apparatus of the illustrated embodiment, a voltage application control means is constituted by a thyristor 43 of which an anode is connected through a switch 22 to a positive terminal of a battery 20 and a cathode is connected to a positive power input terminal of a pump drive motor 21*a*, as well as a resistor 44 connected between the anode of the thyristor 43 and a gate thereof. The remaining part of the illustrated embodiment may be constructed in substantially the same manner as the embodiment described above with reference to FIG. 4.

Alternatively, in the present invention, the voltage application control means arranged in the battery voltage feed circuit may be constituted by a switching circuit which is turned on only when the voltage across the battery is higher than the output voltage of the pump drive circuit while rotation of the internal combustion engine is detected and turned off when the former voltage is lower than the latter voltage while the rotation is detected or when interruption of the engine is detected. Such construction prevents a drive current from being fed from the battery to the fuel pump at the time of interruption of the engine, resulting in the fuel pump being interrupted, so that it is not required to arrange any further switch means in the battery voltage feed circuit.

Figure 6:
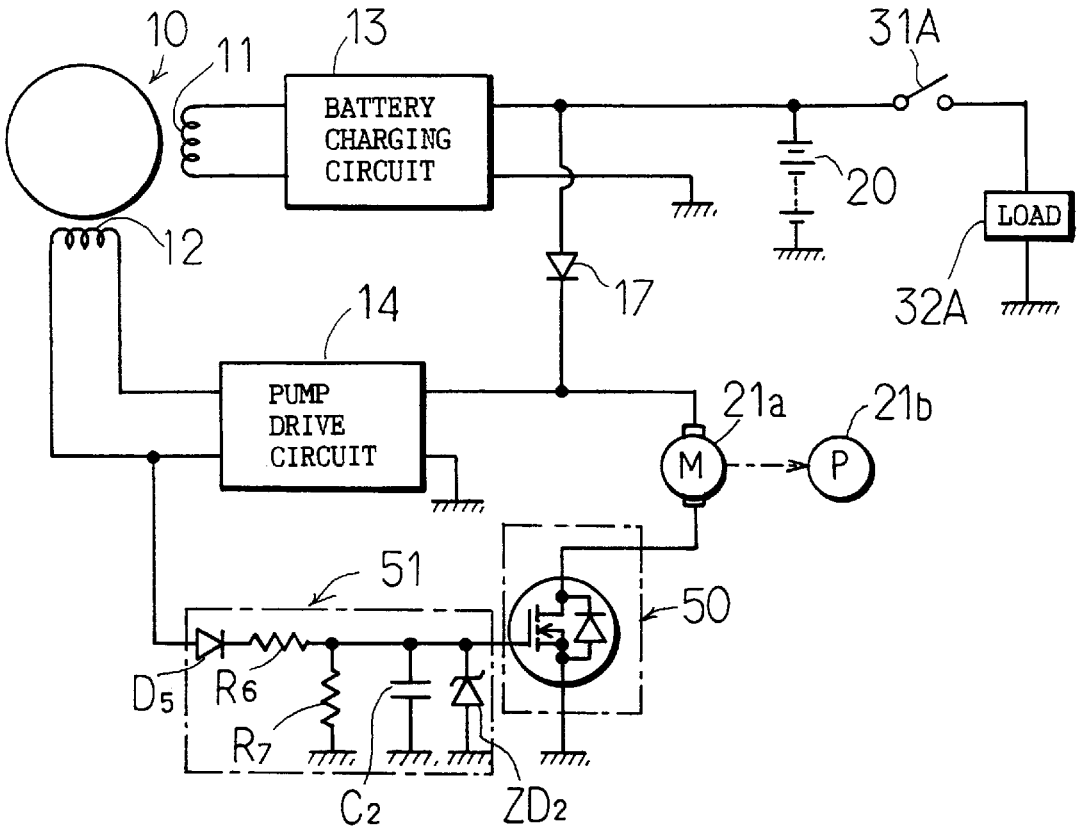
FIG. 6 is a circuit diagram showing still another embodiment of a fuel pump drive apparatus for a fuel injection equipment for an internal combustion engine according to the present invention.

FIG. 6 shows still another embodiment of a fuel pump drive apparatus for a fuel injection equipment for an internal combustion engine according to the present invention, wherein a switching circuit constructed in such a manner as described above is incorporated in the form of a voltage application control means. More particularly, a switching circuit 50 acting as the voltage application control means is connected between a negative power input terminal of a pump drive motor 21*a* and the ground. Reference numeral 51 designates a switch control circuit which functions to detect an output voltage of a pump drive coil 12 to carry out on-off control of the switching circuit 50. In the illustrated embodiment, the switching circuit 50 is constituted by a MOSFET of which a source is grounded and a drain is connected to a negative power input terminal of the pump drive motor 21a. Also, the switch control circuit 51 includes a diode D5 of which an anode is connected to one end of the pump drive circuit 12, a resistor R6 connected between a cathode of the diode D5 and a gate of the MOSFET, a resistor R7 and a capacitor C2 each connected in series to a gate-source circuit of the MOSFET, and a Zener diode ZD2 connected to the gate-source circuit of the MOSFET while keeping an anode thereof facing the ground. In the illustrated embodiment, the pump drive circuit 14 may be constructed in such a manner as shown in FIG. 3 and a voltage regulator of the pump drive circuit may have an adjustment value set to be higher than a maximum value of a voltage across a battery 20. Also, in the embodiment of FIG. 6, arrangement of a power switch is eliminated and an anode of a diode 17 is connected directly to a positive terminal of the battery 20. Further, in the illustrated embodiment, an ignition circuit for igniting an internal combustion engine may be constituted by a circuit of the capacitor discharge type constructed in a manner commonly known in the art wherein an exciter coil arranged in a magneto 10 is used as a power supply therefor.

In the embodiment of FIG. 6 thus constructed, when starting operation of the internal combustion engine is carried out to cause a voltage to be induced across the pump drive coil 12, a drive signal is fed from the pump drive coil 12 through the diode D5 and resistor R6 to the gate of the MOSFET constituting the switching circuit 50, so that the MOSFET is turned on to permit a current to be flowed from the battery 20 through the diode 17, pump drive motor 21*a* and MOSFET. This results in a fuel pump being actuated, to thereby feed an injector with fuel. Also, a voltage induced across the exciter coil (not shown) arranged in the magneto 10 permits the ignition circuit to be driven to carry out ignition operation, leading to starting of the engine. Operation of the pump drive apparatus of the illustrated embodiment after starting of the engine is carried out in substantially the same manner as the apparatus shown in FIG. 1. When operation of the engine is interrupted, the pump drive coil 12 stops generation of a voltage, so that the MOSFET constituting the switching circuit 50 is turned off, to thereby keep an electric power from being fed to the pump drive motor 21*a*. Thus, a drive current is kept from being fed to the fuel pump during interruption of the engine. The pump drive apparatus of FIG. 6 thus constructed is suitably applied to starting of the engine by rope starting or the like while connecting the magneto directly to a load without arranging any power switch as in a watercraft.

In the illustrated embodiment, the capacitor C2 and Zener diode ZD2 cooperate with each other to keep a voltage across the gate-source circuit of the MOSFET constant during operation of the internal combustion engine, to thereby ensure that the MOSFET is positively held turned on.

Figure 7:
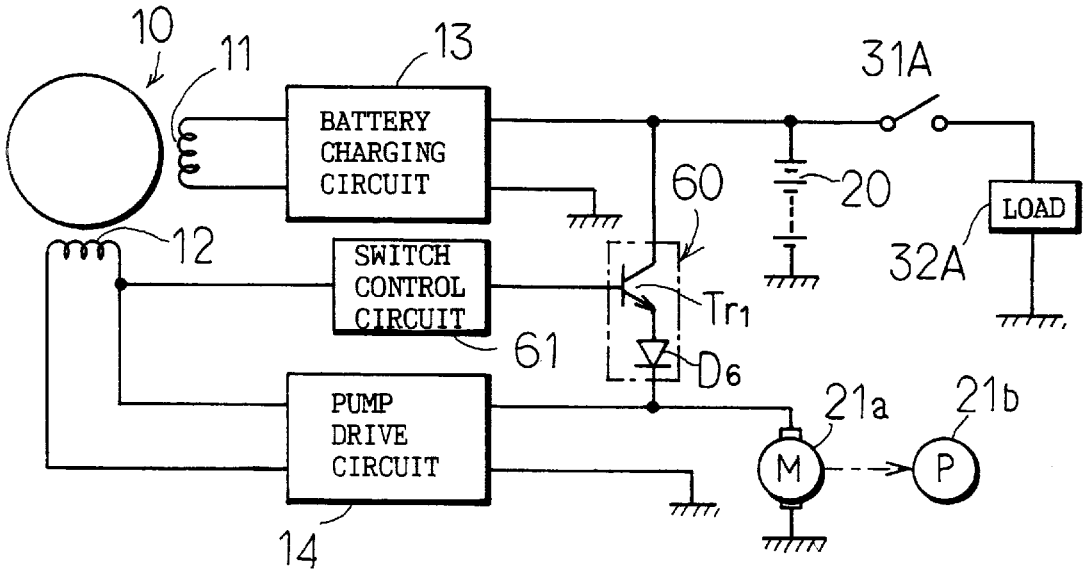
FIG. 7 is a circuit diagram showing yet another embodiment of a fuel pump drive apparatus for a fuel injection equipment for an internal combustion engine according to the present invention.

Referring now to FIG. 7, a still further embodiment of a fuel pump drive apparatus for a fuel injection equipment for an internal combustion engine according to the present invention is illustrated, wherein a switching circuit 60 is substituted for the diode 17 shown in FIG. 1 and arranged between a positive terminal of a battery 20 and a positive power input terminal of a pump drive motor 21*a*. Also, a switch control circuit 61 is arranged so as to detect an output of a pump drive coil 12 to carry out on-off control of the switching circuit 60. In the illustrated embodiment, the switching circuit 60 is constituted by an NPN transistor Tr1 of which a collector is connected to a positive terminal of the battery 20 and a diode D6 of which an anode is connected to an emitter of the transistor Tr1 and a cathode is connected to the positive power input terminal of the pump drive motor 21*a*. The switch control circuit 61 may comprise a circuit for feeding a base current to the transistor Tr1 when the pump drive coil 12 induces a voltage thereacross.

In the embodiment shown in FIG. 7, the transistor Tr1 is turned on to permit a drive current to be fed from the battery 20 to the pump drive motor 21*a* only when a voltage across the battery 20 is higher than an output voltage of a pump drive circuit 14 and the pump drive coil 12 induces a voltage thereacross. When the output voltage of the pump drive circuit 14 is higher than the voltage across the battery 20, a collector-emitter circuit of the transistor Tr1 and the diode D6 are reversely biased to cause the switching circuit 60 to be turned off. The diode D6 functions to prevent breakage of the transistor Tr1 due to application of an excessive reverse voltage across the collector-emitter circuit of the transistor Tr1.

In the illustrated embodiment, the transistor Tr1 is turned on when starting operation of the internal combustion engine takes place to permit the pump drive coil 12 to induce a voltage thereacross, so that a current is fed from the battery 20 through the transistor Tr1 and diode D6 to the pump drive motor 21*a*, resulting in the fuel pump being actuated. When the output voltage of the pump drive circuit 14 is higher than the voltage across the battery 20 after starting of the engine, the transistor Tr1 is turned off, resulting in the battery 20 being separated from the pump drive motor 21*a*.

When operation of the internal combustion engine is interrupted, the pump drive coil 12 stops generating a voltage, so that a base current is kept from being fed to the transistor Tr1 of the switching circuit 60. Thus, a drive current is prevented from being fed from the battery 20 to the pump drive motor 21*a* during interruption of operation of the engine.

The fuel pump drive apparatus shown in FIG. 7 is likewise suitably applied to an internal combustion engine of the type that a magneto is connected directly to a load without arranging any power switch.

In each of the embodiments described above, the fuel pump is constructed of the pump drive motor 21*a* and the pump mechanism 21*b* driven by the motor 21*a*. Alternatively, a fuel pump of the electromagnetic type which is driven by a magneto may be suitably used for this purpose.

As can be seen from the foregoing, the fuel pump drive apparatus of the present invention is so constructed that the voltage application control means is arranged which is turned off when an output voltage of the pump drive circuit is higher than a voltage across the battery and turned on when the former voltage is lower than the latter voltage, resulting in the voltage across the battery being applied across the output terminal of the pump drive circuit through the voltage application control means. Such construction permits a drive current to be fed from the battery to the fuel pump during starting of the internal combustion engine, to thereby ensure starting of the engine. Also, it permits the output voltage of the pump drive circuit to be applied to the fuel pump to drive the fuel pump irrespective of the voltage across the battery during operation of the internal combustion engine. Thus, it is merely required to design the fuel pump so that it may discharge fuel in an amount equal to or more than a maximum fuel demand of the engine, thus, it is not required to discharge fuel in an amount equal to the maximum fuel demand of the engine or more when the voltage across the battery is at a level of a minimum value unlike the prior art. This results in preventing power consumption of the fuel pump from being excessive.

Further, in the fuel pump drive apparatus of the present invention, the fuel pump may be driven by means of the output voltage of the pump drive circuit kept from being affected by the battery. This reduces a load of the battery to a degree sufficient to prevent excessive discharge of fuel from the fuel pump when the voltage across the battery is increased, to thereby permit a control pressure of the pressure regulator to be kept constant with respect to each of fuel demands of the internal combustion engine, resulting in the amount of fuel fed to the engine being controlled with increased accuracy.

Moreover, the apparatus of the present invention may be constructed in such a manner that the voltage across the battery is applied across the output terminal of the pump drive circuit through the voltage application control means and the switch closed only during starting operation of the internal combustion engine. Such construction permits the voltage across the battery to be applied to the fuel pump only during starting of the engine and a voltage to be applied to the fuel pump from the pump drive circuit after the engine is started once. This effectively prevents the fuel pump from being affected by a variation in voltage across the battery irrespective of any rotational speed of the engine during operation of the engine. Thus, it is not required to set an adjustment value of the voltage regulator of the pump drive circuit at a level equal to or higher than a maximum value of the voltage across the battery, to thereby permit a rated drive voltage of the fuel pump to be advantageously set independently from the voltage across the battery.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fuel pump drive apparatus for a fuel injection equipment for an internal combustion engine, comprising:

a battery charging coil and a pump drive coil each arranged in a magneto driven by the internal combustion engine;

a battery charged through a battery charging circuit by means of an output of said battery charging coil;

a pump drive circuit including a rectification circuit for rectifying an output voltage of said pump drive coil and a voltage regulator for restricting an output voltage of said rectification circuit to an adjustment value or less and constructed so as to apply a DC voltage restricted to the adjustment value or less across a power terminal of a fuel pump of the fuel injection equipment for the internal combustion engine; and a battery voltage feed circuit including a voltage application control means turned off when an output voltage of said pump drive circuit is higher than a voltage across said battery and turned on when the output voltage of said pump drive circuit is lower than the voltage across said battery and constructed so as to permit the voltage across said battery to be applied across the power terminal of said fuel pump through said voltage application control means;

the adjustment value of said voltage regulator of said pump drive circuit being set to be higher than a maximum value of the voltage across said battery.

2. A fuel pump drive apparatus as defined in claim 1, wherein said voltage application control means is constituted by a diode which is coupled at an anode thereof to a positive terminal of said battery and at a cathode thereof to an output terminal of said pump drive circuit on a positive polarity side thereof.

3. A fuel pump drive apparatus as defined in claim 1, wherein said voltage application control means is constituted by a switching circuit which is turned on only when the voltage across said battery is higher than the output voltage of said pump drive circuit while rotation of the internal combustion engine is detected and turned off when the voltage across the battery is lower than the output voltage of said pump drive circuit while rotation of the engine is detected and when interruption of operation of the engine is detected.

4. A fuel pump drive apparatus for a fuel injection equipment for an internal combustion engine, comprising:

a battery charging coil and a pump drive coil each arranged in a magneto driven by the internal combustion engine;

a battery charged through a battery charging circuit by means of an output of said battery charging coil;

a pump drive circuit including a rectification circuit for rectifying an output voltage of said pump drive coil and a voltage regulator for restricting an output voltage of said rectification circuit to an adjustment value or less and constructed so as to apply a DC voltage restricted to the adjustment value or less across a power terminal of a fuel pump of the fuel injection equipment for the internal combustion engine; and a battery voltage feed circuit including a voltage application control means turned off when an output voltage of said pump drive circuit is higher than a voltage across said battery and turned on when the output voltage of said pump drive circuit is lower than the voltage across said battery and constructed so as to permit the voltage across said battery to be applied across the power terminal of said fuel pump through said voltage application control means and a switch means closed during operation of the internal combustion engine;

the adjustment value of said voltage regulator of said pump drive circuit being set to be higher than a maximum value of the voltage across said battery.

5. A fuel pump drive apparatus as defined in claim 4, wherein said voltage application control means is constituted by a diode which is coupled at an anode thereof to a positive terminal of said battery through said switch means and at a cathode thereof to an output terminal of said pump drive circuit on a positive polarity side thereof.

6. A fuel pump drive apparatus as defined in claim 4, wherein said voltage application control means is constituted by a switch circuit turned on to connect said battery across an output terminal of said pump drive circuit when a voltage across the output terminal of said pump drive circuit is lower than the voltage across said battery and turned off to separate said battery from the output terminal of said pump drive circuit when the voltage across the output terminal of said pump drive circuit is higher than the voltage across said battery.

7. A fuel pump drive apparatus for a fuel injection equipment for an internal combustion engine, comprising:

a battery charging coil and a pump drive coil each arranged in a magneto driven by the internal combustion engine;

a battery charged through a battery charging circuit by means of an output of said battery charging coil;

a pump drive circuit including a rectification circuit for rectifying an output voltage of said pump drive coil and a voltage regulator for restricting an output voltage of said rectification circuit to an adjustment value or less and constructed so as to apply a DC voltage restricted to the adjustment value or less across a power terminal of a fuel pump of the fuel injection equipment for the internal combustion engine; and a battery voltage feed circuit including a voltage application control means turned off when an output voltage of said pump drive circuit is higher than a voltage across said battery and turned on when the output voltage of said pump drive circuit is lower than the voltage across said-battery and constructed so as to permit the voltage across said battery to be applied across the power terminal of said fuel pump through said voltage application control means and a switch closed only during starting of the internal combustion engine.

8. A fuel pump drive apparatus as defined in claim 7, wherein said voltage application control means is constituted by a diode which is coupled at an anode thereof to a positive terminal of said battery through said switch and at a cathode thereof to an output terminal of said pump drive circuit on a positive polarity side thereof.

9. A fuel pump drive apparatus as defined in claim 7, wherein said voltage application control means is constituted by a switch circuit turned on to connect said battery across an output terminal of said pump drive circuit when a voltage across the output terminal of said pump drive circuit is lower than the voltage across said battery and turned off to separate said battery from the output terminal of said pump drive circuit when the voltage across the output terminal of said pump drive circuit is higher than the voltage across said battery.

10. A fuel pump drive apparatus for a fuel injection equipment for an internal combustion engine, comprising:

a battery charging coil and a pump drive coil each arranged in a magneto driven by the internal combustion engine;

a battery charged through a battery charging circuit by means of an output of said battery charging coil;

a pump drive circuit including a rectification circuit for rectifying an output voltage of said pump drive coil and a voltage regulator for restricting an output voltage of said rectification circuit to an adjustment value or less and constructed so as to apply a DC voltage restricted to the adjustment value or less across a power terminal of a fuel pump of the fuel injection equipment for the internal combustion engine; and a battery voltage feed circuit including a voltage application control means turned off when an output voltage of said pump drive circuit is higher than a voltage across said battery and turned on when the output voltage of said pump drive circuit is lower than the voltage across said battery and constructed so as to permit the voltage across said battery to be applied across the power terminal of said fuel pump through said voltage application control means;

the adjustment value of said voltage regulator of said pump drive circuit being set to be higher than a maximum value of the voltage across said battery;

said pump drive coil being constructed so as to output a voltage equal to or higher than the adjustment value of said voltage regulator of said pump drive circuit while said internal combustion engine is rotated at a rotational speed equal to or higher than that during idling thereof.

11. A fuel pump drive apparatus as defined in claim 10, wherein said voltage application control means is constituted by a diode which is coupled at an anode thereof to a positive terminal of said battery and at a cathode thereof to an output terminal of said pump drive circuit on a positive polarity side thereof.

12. A fuel pump drive apparatus as defined in claim 10, wherein said voltage application control means is constituted by a switching circuit which is turned on only when the voltage across said battery is higher than the output voltage of said pump drive circuit while rotation of the internal combustion engine is detected and turned off when the voltage across the battery is lower than the output voltage of said pump drive circuit while rotation of the engine is detected and when interruption of operation of the engine is detected.

13. A fuel pump drive apparatus for a fuel injection equipment for an internal combustion engine, comprising:

a battery charging coil and a pump drive coil each arranged in a magneto driven by the internal combustion engine;

a battery charged through a battery charging circuit by means of an output of said battery charging coil;

a pump drive circuit including a rectification circuit for rectifying an output voltage of said pump drive coil and a voltage regulator for restricting an output voltage of said rectification circuit to an adjustment value or less and constructed so as to apply a DC voltage restricted to the adjustment value or less across a power terminal of a fuel pump of the fuel injection equipment for the internal combustion engine; and a battery voltage feed circuit including a voltage application control means turned off when an output voltage of said pump drive circuit is higher than a voltage across said battery and turned on when the output voltage of said pump drive circuit is lower than the voltage across said battery and constructed so as to permit the voltage across said battery to be applied across the power terminal of said fuel pump through said voltage application control means and a switch means closed during operation of the internal combustion engine;

the adjustment value of said voltage regulator of said pump drive circuit being set to be higher than a maximum value of the voltage across said battery;

said pump drive coil being constructed so as to output a voltage equal to or higher than the adjustment value of the voltage regulator of said pump drive circuit while said internal combustion engine is rotated at a rotational speed equal to or higher than that during idling thereof.

14. A fuel pump drive apparatus as defined in claim 13, wherein said voltage application control means is constituted by a diode which is coupled at an anode thereof to a positive terminal of said battery through said switch means and at a cathode thereof to an output terminal of said pump drive circuit on a positive polarity side thereof.

15. A fuel pump drive apparatus as defined in claim 13, wherein said voltage application control means is constituted by a switch circuit turned on to connect said battery across an output terminal of said pump drive circuit when a voltage across the output terminal of said pump drive circuit is lower than the voltage across said battery and turned off to separate said battery from the output terminal of said pump drive circuit when the voltage across the output terminal of said pump drive circuit is higher than the voltage across said battery.

16. A fuel pump drive apparatus for a fuel injection equipment for an internal combustion engine, comprising:

a battery charging coil and a pump drive coil each arranged in a magneto driven by the internal combustion engine;

a battery charged through a battery charging circuit by means of an output of said battery charging coil;

a pump drive circuit including a rectification circuit for rectifying an output voltage of said pump drive coil and a voltage regulator for restricting an output voltage of said rectification circuit to an adjustment value or less and constructed so as to apply a DC voltage restricted to the adjustment value or less across a power terminal of a fuel pump of the fuel injection equipment for the internal combustion engine; and a battery voltage feed circuit including a voltage application control means turned off when an output voltage of said pump drive circuit is higher than a voltage across said battery and turned on when the output voltage of said pump drive circuit is lower than the voltage across said battery and constructed so as to permit the voltage across said battery to be applied across the power terminal of said fuel pump through said voltage application control means and a switch closed only during starting of the internal combustion engine;

said pump drive coil being constructed so as to output a voltage equal to or higher than the adjustment value of said voltage regulator of said pump drive circuit while the internal combustion engine is rotated at a rotational speed equal to or higher than that during idling thereof.

17. A fuel pump drive apparatus as defined in claim 16, wherein said voltage application control means is constituted by a diode which is coupled at an anode thereof to a positive terminal of said battery through said switch and at a cathode thereof to an output terminal of said pump drive circuit on a positive polarity side thereof.

18. A fuel pump drive apparatus as defined in claim 16, wherein said voltage application control means is constituted by a switch circuit turned on to connect said battery across an output terminal of said pump drive circuit when a voltage across the output terminal of said pump drive circuit is lower than the voltage across said battery and turned off to separate said battery from the output terminal of said pump drive circuit when the voltage across the output terminal of said pump drive circuit is higher than the voltage across said battery.

* * * * *